US010422120B2

(12) United States Patent
Harr

(10) Patent No.: US 10,422,120 B2
(45) Date of Patent: Sep. 24, 2019

(54) FORWARD ARTICULATING CLEANING AND REMOVAL APPARATUS AND METHOD

(71) Applicant: HARR TECHNOLOGIES, LLC, Kasilof, AK (US)

(72) Inventor: Robert Harr, Kasilof, AK (US)

(73) Assignee: HARR TECHNOLOGIES, LLC, Kasilof, AK (US)

( * ) Notice: Subject to any disclaimer, the term of this patent is extended or adjusted under 35 U.S.C. 154(b) by 326 days.

(21) Appl. No.: 15/407,103

(22) Filed: Jan. 16, 2017

(65) Prior Publication Data

US 2017/0203338 A1 Jul. 20, 2017

Related U.S. Application Data

(60) Provisional application No. 62/280,472, filed on Jan. 19, 2016.

(51) Int. Cl.

| | |
|---|---|
| ***E03F 9/00*** | (2006.01) |
| ***B08B 9/045*** | (2006.01) |
| ***B08B 9/043*** | (2006.01) |
| ***B08B 9/047*** | (2006.01) |

(52) U.S. Cl.

CPC ..... *E03F 9/005* (2013.01); *B08B 9/043* (2013.01); *B08B 9/045* (2013.01); *B08B 9/047* (2013.01); *B08B 9/0436* (2013.01); *E03F 9/002* (2013.01); *B08B 2209/04* (2013.01)

(58) Field of Classification Search

CPC .. E03F 9/00; E03F 9/002; E03F 9/005; B08B 9/04; B08B 9/043; B08B 9/0436; B08B 9/045; B08B 9/047

USPC ..... 15/104.05, 104.07, 104.09, 104.095, 15/104.096, 104.11, 104.13, 104.14, 15/104.31, 104.32

See application file for complete search history.

(56) References Cited

U.S. PATENT DOCUMENTS

| | | | | |
|---|---|---|---|---|
| 1,145,927 | A * | 7/1915 | Shorten | H01L 21/67781 15/104.096 |
| 2,637,866 | A * | 5/1953 | Kiesler, Sr. | E03F 9/002 15/104.33 |
| 7,398,785 | B2 | 7/2008 | Harr | |
| 7,721,375 | B2 | 5/2010 | Harr | |
| 7,725,978 | B2 | 6/2010 | Harr | |

(Continued)

FOREIGN PATENT DOCUMENTS

DE 2948647 * 6/1981

*Primary Examiner* — Mark Spisich

(74) *Attorney, Agent, or Firm* — Trenner Law Firm, LLC; Mark D. Trenner

(57) ABSTRACT

A forward articulating cleaning and removal apparatus for cleaning a drainage structure. An example apparatus includes a housing to extend into a structure to be cleared and/or removed, through an open end of the structure to be cleared. The example apparatus also includes a distal edge formed on the housing to cut or loosen debris. At least one coil within the housing moves the cut or loosened debris away from the distal edge formed on the housing to a proximal end of the housing. A debris escape opening is formed in the proximal end of the housing. A stem at the proximal end of the housing is provided for connecting to a rotational power source to drive the housing. The example apparatus includes at least one cutting edge on the distal edge of the housing and/or the at least one coil within the housing.

20 Claims, 9 Drawing Sheets

(56) References Cited

U.S. PATENT DOCUMENTS

| | | | |
|---|---|---|---|
| 8,303,215 | B2 | 11/2012 | Harr |
| 8,347,446 | B2 | 1/2013 | Harr |
| 8,545,130 | B2 | 10/2013 | Harr |
| 8,556,539 | B2 | 10/2013 | Harr |
| 9,290,993 | B2 | 3/2016 | Harr |
| 2005/0097689 | A1 | 5/2005 | Harr |
| 2005/0214070 | A1 | 9/2005 | Harr |
| 2006/0157083 | A1 | 7/2006 | Harr |
| 2006/0157096 | A1 | 7/2006 | Harr |
| 2006/0243303 | A1 | 11/2006 | Harr |
| 2007/0098500 | A1 | 5/2007 | Harr |
| 2007/0186963 | A1 | 8/2007 | Harr |
| 2008/0028566 | A1 | 2/2008 | Harr |
| 2008/0127438 | A1 | 6/2008 | Harr |
| 2010/0181110 | A1 | 7/2010 | Harr |
| 2012/0087739 | A1 | 4/2012 | Harr |
| 2013/0058713 | A1 | 3/2013 | Harr |
| 2013/0180549 | A1 | 7/2013 | Harr |
| 2014/0027183 | A1 | 1/2014 | Harr |
| 2014/0030021 | A1 | 1/2014 | Harr |
| 2014/0110177 | A1 | 4/2014 | Harr |
| 2014/0112721 | A1 | 4/2014 | Harr |
| 2015/0258586 | A1 | 9/2015 | Harr |
| 2015/0369394 | A1 | 12/2015 | Harr |

* cited by examiner

FORWARD ARTICULATING CLEANING AND REMOVAL APPARATUS AND METHOD

PRIORITY CLAIM

This application claims the priority benefit of U.S. Provisional Patent Application No. 62/280,472 filed Jan. 19, 2016 titled "Forward Articulating Cleaning and Removal Apparatus and Method" of Robert Harr, hereby incorporated by reference in its entirety as though fully set forth herein.

BACKGROUND

Drainage structures are still in use, in some cases, well beyond the age which was intended. As such, deterioration and failures may occur and can pose risk to public health and safety and/or environmental issues. These drainage structures often have to be replaced. It is often preferable to have these drainage structures removed using so-called "trenchless" techniques, wherein the roadway or other structure adjacent the drainage structure does not have to be torn apart. Even if these drainage structures cannot be replaced, at the very least debris buildup (e.g., whether from forces of nature or man-made) has to be removed.

In any case, whether replacing or for debris removal, it is important that procedures are performed correctly in order to preserve the integrity of the drainage structure for cleaning and/or a trenchless replacement. Failure to properly perform these techniques can lead to failure of the drainage structure resulting in caving which can cause a void under the road or other structure. This void may then lead to failure of the road or other structure.

Equipment to install a casing pipe for utilities, drainage structures, and culverts do not offer full service solutions. The manufacturers claim no responsibility for the end user to allow the users choice to alternative methods or tools of debris removal. This normally ends in failures and a hazard to the public.

DETAILED DESCRIPTION

Figure 1:
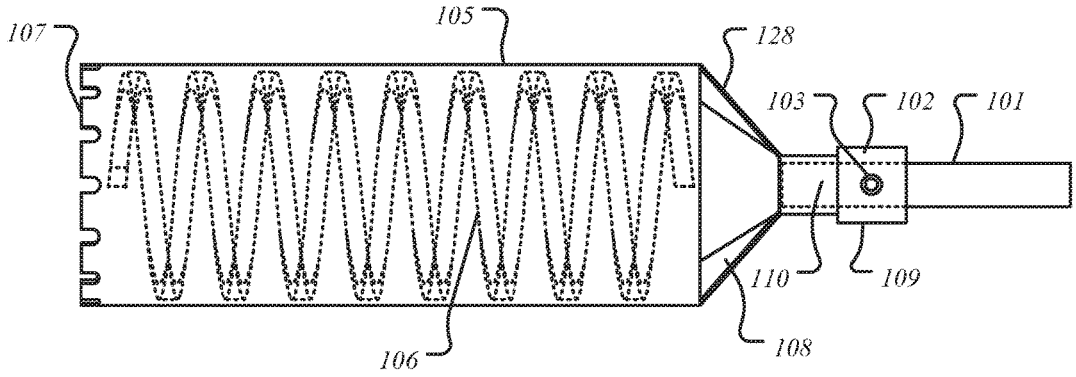
FIG. 1 is a cut away view of the Forward Articulated Cleaning (FAC) and Removal (FAR) apparatus.

Millions of people travel daily on the roads and other transportation surfaces (e.g., bridges, overpasses) in the United States and other countries. Failures in these transportation surfaces may occur due to lack of maintenance, thereby costing the taxpayers billions of dollars per year as well as the potential for property damage, risk of injury and/or loss of life.

With new Environmental Protection Agency (EPA) guidelines being implemented, turbidity in waterways and cross-contamination of elements stored with solids within a structure, are not tolerated during installation/removal of drainage structures. The Department Of Defense, Oil companies, Railroads, Nuclear Facilities and other agencies have problematic issues with contamination inside drainage structures and/or culverts. No, or at most only limited mitigation, is permitted during the cleaning processes and must be accomplished dry. However, this means not using a metal alloy that could cause a fire, explosion, and in some cases, corrosion or chemical reaction.

In an example application, the removal of a drainage structure may need to be performed while on a rail track due to no embankment to work from or a water way working from a landing craft, large boat or barge anchored in place to remove debris or complete a trenchless drainage structure installation. Transportation surfaces such as railways, roadways and even airport runways have been built on waterways in which the only access is by water unless the transportation surface is shut down for maintenance or repair. In some cases this is not acceptable due to scheduling, or may be the only route in remote areas with restrictions when a detour cannot be established. Other devices have been broken off, loosened off, or even driven through degradations, causing section failures right into the traveled surfaces, causing more issues. In other cases, culverts have been pushed out or removed by becoming entangled in a devise used by persons not trained and qualified.

Before an attempt is made to swallow an existing drainage structure, cleaning of the existing structure must take place to profile the drainage structure to make the appropriate decision of elevation, grade, and if the swallow is the method to resolve the issue. Too often, the existing drainage structure is not compatible with a swallow method due to the lack of not profiling the existing structure. Not cleaning the structure along with a profile has led to health and safety risk to the transportation system. When a new drainage structure is being installed, which has engaged an existing structure that is sized wrong or displaced in some way, a swimming motion may occur. This motion can create a caving effect causing the soils around or above the structure to create a void under a transportation surface or under a facility.

Examples of a forward articulating cleaning apparatus are disclosed herein which may be used for cleaning and/or removal of drainage structures. The apparatus may be implemented in conjunction with controls to preserve the investment of the infrastructure. Tooling including the couplers, fasteners, or angular stem connections can be manufactured from aluminum, plastics, fiberglass, carbon fibers or other suitable alloys to prevent environmental contamination. In an example, the apparatus has a drive coupler in which a drainage structure may be installed by swallowing a collapsed or deteriorated drainage structure such as a culvert. It is noted that there are multiple variations of sized pipe that do not allow currently manufactured collets to fit inside the host pipe properly. The driving coupler of the apparatus disclosed herein is operable with the multi-manufacture methods of pipe today. In addition, a shock absorption device disclosed herein is better capable to attach the cone or collet assemblies to the structure.

During the process of a trenchless installation of a drainage structure, resistance or refusal may be encountered. At this point, a Forward Articulated Cleaning (FAC) method and tool disclosed herein can be used for the removal of debris to allow the drainage structure to progress in a forward motion. The FAC is capable of removing very large debris because there is no center axis involved in the tool. The center axis is removed so that large debris may enter the inside of the tool, becoming nonrestrictive for debris to enter from the drainage structure. The tooling is considered for the size of the structure, size of debris being encountered, and type of debris being removed. The tooling may have multiple cutting components or forms for the loosening and cutting, but is not limited to the use of air, water, or steam through the angular stem connection. A configured hammer assembly may also be provided for downsizing larger debris encountered.

In an example, the apparatus disclosed herein does not have a center longitudinal axis located within the oval housing. This configuration enables larger restrictive debris to be engulfed into the housing and to be secured for withdrawal from the structure. An interior spherical chambered coil attached to the housing, the coil being larger at distal end and smaller at the proximal end in an example, tightens the debris while rotating clockwise and loosens with a counter-clockwise motion.

The angular stem has a longitudinal void for fluids, steam, air or other pressurized fluids to assist in the debris removal or DHT operations. The longitudinal centralizing axis' angular stem has sealed angular couplers at the distal and proximal ends with a fastener, pin or bolt assembly which is used to secure the angular stem joints in place. The fasteners may also have fabricated seals such as rubber, nylon, or plastics for additional sealing. The angular stem is slightly undersized so that it fits tightly into the angular coupler when the angular stem is installed inside the angular coupler and then pinned or bolted into place. Angular stem and angular couplers may be added from the ground engaging equipment connection providing communication with a longitudinal centralizing axis to achieve the length desired. Multiple sized tools may be used in the apparatus so that the debris can be removed successfully.

Within the oval housing is a securing assembly to attach a DHT (hammer assembly). The DHT is assembled to reduce the size of debris or fracture large refusal materials so trenchless equipment such as auger machines or pipe ramming may resume. The DHT may be used for downsizing debris so the FAC may swallow the debris completely for removal. The apparatus is connected with sealed couplers via the angular stem connections to the supply system to operate the DHT and ground engaging or operable equipment. The eccentric movement may cause fracturing of debris while rotation and forwarding of the distal end is produced with pressurized fluids, gases or air as the supply to power the DHT. There is a plurality of portholes for exhaust of the DHT but also within the housing when selected for additional lubrication or needed assist in cutting, melting or loosening of debris. A plurality assembly of additional teeth may be added if necessary or brushing configurations for final cleaning.

Before continuing, it is noted that as used herein, the terms "includes" and "including" mean, but is not limited to, "includes" or "including" and "includes at least" or "including at least." The term "based on" means "based on" and "based at least in part on."

FIG. 1 is a cut away view of the Forward Articulated Cleaning (FAC) and Removal (FAR) apparatus 100. In an example, the apparatus 100 may have longitudinal centralizing, communication, angular stem, and/or coupler connection aspects described herein. A longitudinal centralizing angular stem 101 provides communication, e.g., between a housing 105 and a power source (see, e.g., FIGS. 2 and 4). The stem 101 has a proximal end 110, a distal end, and is angularly coupled with multiple fastener settings. The angular stem 101 at the distal end 110 is coupled substantially to the longitudinally, oval shaped housing 105 at the distal end. The angular stem 101 may have multiple lengths that are compatible for obstruction or debris removal from culverts or drainage structures.

In an example, the angular stem 101 may range between 4 feet to over 20 feet in length and ranging from 1 inch to 6 inches in multiple shapes which include but not limited to, hexagonal, square, rectangular, triangular or unthreaded round. The angular stem 101 may be commercially available or may be custom made depending on the user. The longitudinal centralizing angular stem 101 in some cases may be made from commercially or specifically manufactured from solid stock or with a longitudinal void with in steel, aluminum, other suitable alloy metals. In some applications angularity of plastics, fiberglass, carbon fibers or polymers may also be used.

The angular stem 101 comprises an angular coupler 102 with a fastener 103 seals or non-sealed 109 at its proximal and distal ends. The couplings are attached to the angular stems to the tools housings and to the ground engaging or circumstantially warranted equipment or other devices that have the ability to rotate forward and reverse motions and travel in a forward and reverse or push and pull. The couplers and angular couplings are suitable for the releasably attaching the angular stem 101 to additional angular stems or ground engaging circumstantially warranted devices. The angular coupling or couplers 102 may be integral with the angular stem 101 or attached as a separate component, by welding for example and may be composed of similar materials as the angular stem 101.

The angular stem 101 and the coupling 102 may have a longitudinal void channel defined there in to provide a means for introducing pressurized fluids gases or other solutions from a supply line communication to the ground engaging circumstantially warranted equipment, then to distal end of the housing 105, but through the angular stem 101, its couplers 102, and the sealed fastener assembly 103 and 109. The angular stem may pass through and into the adjoining slightly oversized additional angular stem with coupler 102 on the distal end 110 for the use of additional telescoping of the angular stems lengths 101.

A longitudinal void 104A serving as a built-in supply line and connecting to the supply line 104 (or directly to the supply) may have portholes or a releasably attaching device or mechanism to accompany additional tools 107 which may aid in additional downsizing or debris removal such as the hammer assembly 111 and 112. The longitudinal oval shaped housing 105 has extended protrusions 107 or formed edge, cut into the housing during the manufacturing process.

The housing 105 may be made of pipe, castings, steel, iron, suitable alloy metals, fiberglass, carbon fibers, or plastics for example. In some cases the oval shaped housing 105 and its serrated protrusions 107 are shaped and may be made from work hardening materials with in the serrated protrusions 107 or formed edge, may also be coated with hardening materials such as tungsten carbides chunks, welded, brazed or welded in housings which have inserted, conducting systems such as teeth.

The longitudinal centralizing angular stem 101 may coincide with the central axis of the longitudinal oval housing 105. The housing and/or its assemblies 105 may be chosen to the approximate profiled and cross sectioned, by measurement and survey of the culvert, drainage structure, new casing or pipe being installed.

The new or existing drainage structures, culverts, pipe or casing to be cleaned may range from 4 inches to 14 feet in diameter. Various lengths, sizes, and thicknesses of the longitudinal oval shaped housing 105 may be required do to the sizes of the articles needing cleaned and various sized debris or obstructions that must be removed. The internal components or spiral coiled assemblies 106 of the housing 105 are not limited in size in which to be increased or decreased in thickness, width, height or longitudinal lengths. The debris opening 108 at the distal end of the housing 105 may enable smaller debris to pass if the user allows or the opening 108 may be chosen to be closed with suitable materials by fasteners or welding.

The longitudinal oval shaped housing 105 and the loosing or downsizing implements such as 107 may be fastened or welded to the housing 105. The implements are held away from the walls of the culvert, casing or pipe as well as liners or other material coating so damage is not done to the inter surfaces.

In an example, the shape and the positioning of the internal spiral coil assembly 106 dictates the direction or locking of debris within the housing 105 for removal out of the structures, pipe, and casings. The action of the internal spiral coil assembly 106 rotation motion with the ground engaging or circumstantially warranted equipment (see, e.g., FIG. 2) gathers debris into the housing 105 or release, and can be removed after the user desires to push and rotate or travel in a forward or reverse motion.

The configuration within the housing 105 may support the downsizing or heat reductions from motions of the housing 105 or processes. The ground engaging or circumstantially warranted equipment (see, e.g., FIG. 4) is equipped with supporting connections to aid the processes necessary for successfully removing debris. The angular stem connection 101 with stem connection coupler arrangements 109 having a longitudinal void communication to the ground engaging or operable equipment that controls the supply, may be utilized for the implementations to be charged with air, gasses, steam, fluids or other solutions from the supply 104. The longitudinal void communication from the supply through the angular stems 101 and angular stem connection couplers 102 may provide the elements for cooling, operations of tooling within the housing 105, or lubrications as desired.

Figure 2:
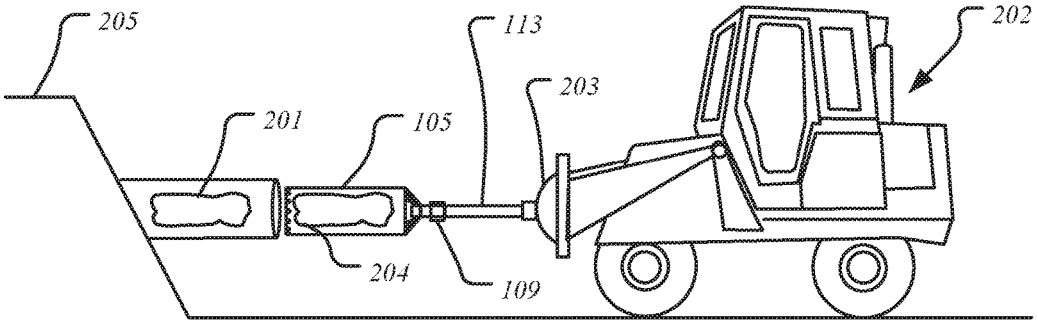
FIG. 2 is an illustration of example operation of the apparatus for the removal of very large debris with ground engaging or circumstantially warranted equipment.

FIG. 2 demonstrates the operation of the apparatus for the removal of very large debris with ground engaging or circumstantially warranted equipment. The possible environment is not limited to an existing culvert or drainage structure. Newly installed casing or pipe may have the same issues or even greater issues of debris lodged inside the structure which must be removed. The figure includes a cut away view of utilizing ground engagement or circumstantially warranted equipment 202 for the removal of debris 201. However in some examples, the operating equipment is not limited to being on the ground, but may also be utility on rail or on a waterway such as off of a barge or boat application.

The tool may be used to clean a culvert, casing, drainage structure or pipe. The tool may also be used in a drainage ditch, or other confined space areas where debris have clogged the passages. The tools with the angular stem 101 and angular stem connection assemblies 109 allow multiple selections of ground engagement or circumstantially warranted equipment 202 configurations. The use of multiple configurations of ground engaging or circumstantially warranted equipment 202 enable any size the user may need to accommodate ground conditions, accessibility, desirable depths, lengths, conforming with environmental compliances, or items' disclosed (see, e.g., FIG. 6). However the ground engaging or circumstantially warranted equipment 202 may have devices or attachable devices 203 to aid in rotation with a forward and reverse motion and be able to travel the angular stem 101 and the coupler connections 109 in a back and forth motion.

Figure 3:
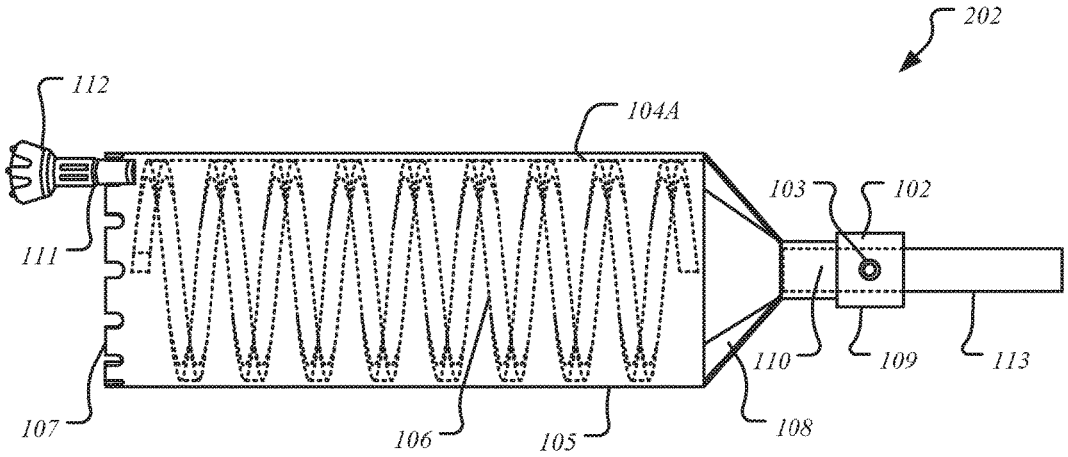
FIG. 3 is a partly a cut away view of a Forward Articulated Cleaning (FAC) Tool with an alternate assembly configured to be a Hammering Attachment or (DHA).

FIG. 3 is a partly a cut away view of a Forward Articulated Cleaning (FAC) Tool with an alternate assembly configured to be a Hammering Attachment or (DHA). The figure also shows a cutaway view of an additional component located within the longitudinal tool housing 105 utilizing the spiral coil assembly 106, with an attached supply 109 to the angular stem 101 providing a centralizing axis attached to the housing 105 by welding or fasteners 103.

The DHA or hammer assembly 111 is secured with fasteners to the housing 105 with a communication void channel supply line 104 with a releasably interchangeable bit 112 configured to the hammer. The DHA assembly operates from a supply line 104 of pressurized fluids, gases, air, or other solutions to power the actuation, vibrations, movements to which the hammer mechanism 111 produces pressure, vibrations but not limited to certain movements communicated to the multiple selection of bits 112 or end devices of the user's choice.

As explained above with reference to FIG. 1, the housing 105 may be coupled by angular void connections 109/102 to the angular stem 101 longitudinal voids with communication and coupled connections 102 to the ground engaging or circumstantially warranted equipment 202 power sources 203 and supply line 104. When all configurations are angularly coupled in communication to the ground engaging or circumstantially warranted equipment 202 power source 203, the housing with component 105 is then rotated into the drainage structure, casing or pipe with the supply system line 104 charged to pressure the DHA assembly 111.

The supply line 104 may be shut off and pressures reduced before disconnecting the connections 113 and adding additional angular stem sections 101 with couplers 102/109 which may be needed to achieve the length of the refusal, using for downsizing debris, or to achieve the full length of the passage being cleaned.

Figure 4:
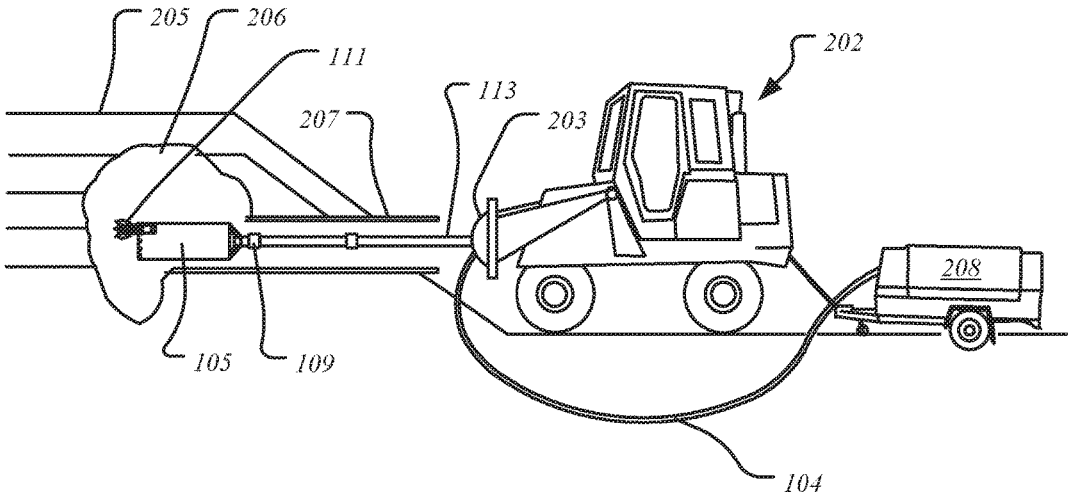
FIG. 4 is an illustration of an example environment of debris removal tooling accompanied by the apparatus, which assists in downsizing for removal or fracturing, conducting, or displacing of the obstruction of the existing structure or new casing or pipe being installed.

FIG. 4 is an illustration of an example environment of debris removal tooling accompanied by the alternative assembly which assists in downsizing for removal or fracturing, conducting, or displacing of the obstruction in front of but not limited to what debris are inside of the existing structure or new casing or pipe being installed. The figure also shows use of Ground Engaging or Circumstantially Warranted Equipment with a Longitudinal Centralizing Communication, Angular Stem Connection and its Couplers, coupled to the supply for the alternative tooling to be used.

The tool housing is shown coupled with the angular stem connections is rotated into the refusal obstructions. When the components within the housing 105 are rotated with supply line 104 pressured the DHA assembly 111 is breaking down the obstruction.

The DHA assembly 111 may be exhausting pressurized substances from the portal voids that the user selected for additional cooling or lubrications. The housing 105, being with in a centralizing axis, and with the DHA assembly 111 affixed to the innermost outer part of the housing 105 acts as an eccentric while being rotated by the ground engaging or circumstantially warranted 202 power sources 203.

The forces applied by the multiple component may cause fracturing, cutting, serration or displacements of the debris obstruction encountered 206 within or in the frontal end of the drainage structure, casing, pipe, liner or passage 207. Obstruction debris 206 can be loaded by the spherical spiral coil 106 within the housing 105 while additional components are in action with the continued forward travel and rotation from the ground engaging or circumstantially warranted equipment 202, power source 203 and supply line 104.

Once the longitudinal housing assembly 105 is full the processes are reversed as disclosed in the discussion stated in the above examples. Once the housing 105 has exited the structure, culvert, pipe, casing or passage 207 a reverse rotation and reverse travel by ground engaging or circumstantially warranted equipment 202 may be provided for the release of debris 206 and clearing of the housing 105. The processes within the writing of this discussion may be repeated until debris removal and obstructions have been sufficiently cleared and accepted.

Figure 5:
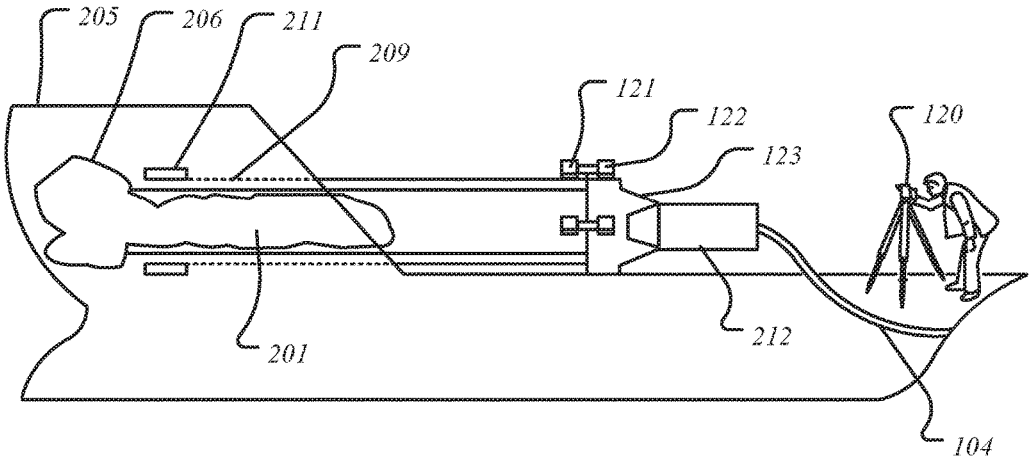
FIG. 5 is a cut away view of the apparatus within an environment of a structure being installed.

FIG. 5 is a cut away view of the apparatus within an environment of a structure being installed after being properly profiled for the trenchless installation of a new casing or pipe swallowing an existing drainage structure that is damaged with refusals and debris inside. There is also a perspective view of the cone/collet assembly, in which the frontal tapered end is lodged securely into the cone/collet assembly securely Connected with Oversized Fasteners to the host casing or pipe. A drive cone and collet assembly with profiling is also shown.

FIG. 5 also shows a cut away view of a failed structure 209 under a traveled surface 205. Example of a possible history of the area affected is a venturi effect, creating a void failure under the traveled surface 205. The void may be partially due to a band failure section, possible deterioration, or collapse of some kind drawing the soils, fill materials 201 or otherwise through the open section of the existing drainage structure, culvert, pipe, passageway, or casing 209. Often times the affected area may be temporally filled with obstructive materials 206 to disallow any additional damage to the traveled surfaces 205 until the area of interest is repaired by appropriate means, methods and meeting regulatory guidelines.

Profiling has been completed to use the swallowing method 207. The method of profiling are further discussed below. The newly desire casing or pipe has been chosen to fully swallow the existing structure in place in accordance with history and the profiling flow charts.

First, a hardened soil shoe 211 is attached by welding a section of hardened alloy metals, or hardened metals welded or brazed such as tungsten's to the distal or frontal end of the host casing, or pipe. Survey 120 and pipe/casing or drainage structure 207 alignments are set by survey 120 to the profile. The newly developed driving cones 123 are installed with large fasteners 122 welded or fastened 121 to the cone assemblies 123 and to the said host, casing, pipe or new drainage structure 207 being installed under the traveled surface 205.

Older collet assemblies may have split or misshaped the host structures during the installation process. Many times, an older version of the collet assemblies 123 do not adapt or fit as purposed due to the multiple manufactures of the product pipe/casings or structures 207 being installed.

For safety reasons and with limiting potential damage to equipment, a newer version of the attaching devices as described herein. The large fasteners 122 with housings have the ability to further tighten the cone/collet assemblies 123 to the host structure 207 being installed as referred to herein as face plate to face edge of the host structure 207.

Once all assemblies have been achieved, the hammer 212 with air or other power supply 208 feeding line 104 is activated with the structure 207 moving in a forward motion. Additional sections of drainage structure, pipe, casing 207 or other materials used in the installation may be added to achieve the desired lengths of completion.

The supply line 104, hammer 212, cone/collet assemblies 123 can be removed. At times even debris 201 has to be removed when adding sections to limit resistance of the installation processes. The examples discussed with reference to FIG. 2 or 4 may be utilized by the user until completion is accomplished. Welding or affixing additional sections may be accomplished (see, e.g., FIG. 5).

The structure 207 being installed simulates encountering a manmade obstruction 206 placed to stop the erosion from under the travel surface 205. This illustration shows a refusal point 206 in which the hammer 212 energy has stopped the forward movement of the structure 207. The user disassembles the supply line 104, hammer 212, con/collet assemblies 123 from the structure 207 to begin debris removals utilizing the description, components (e.g., shown in FIGS. 3-4).

The processes may continually repeated utilizing all or parts of the examples shown and described in the figures.

Figure 6:
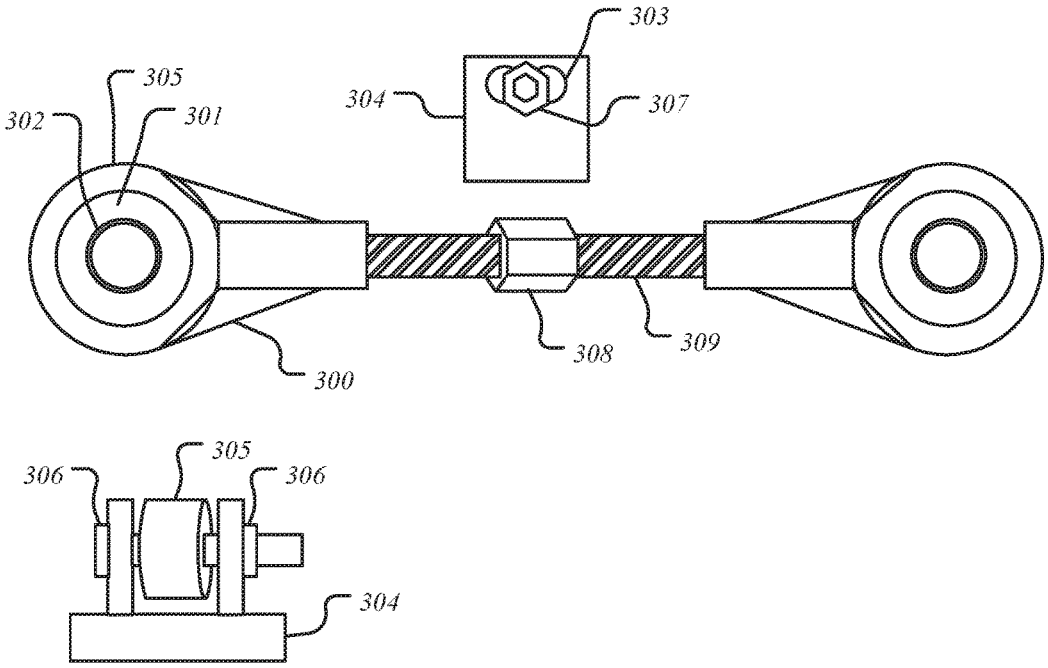
FIG. 6 shows an oversized fastener with a frequency shock absorption assembly with securement blocks.

FIG. 6 is a view of an oversized fastener with a frequency shock absorption assembly with securement blocks. The oversized fastener may have elongated hole patterns within the attachment support assemblies with shock absorption materials such as plastic compounds, rubber compounds or other suitable compounds. Additional examples within the shock absorbing compounds are included but not limited to a passage or void filling longitudinal inserted housing, which provides a wear resistant housing. The wear resistant tubular housing may include, but is not limited to, steel, carbon fibers, plastics and synthetics to which is sized to the fasteners of the users desired size of choice or manufacturer requirements.

An example axis alignment has both left and right handed threaded solid stocks made from suitable materials, with thickened coupling thread bar designs, and has a manufactured, milled, casted, or otherwise developed hexagonal or angular device in the middle of the left and right handed thread for the ability of tightening and loosening. The threaded solid stock connection which provides a centralizing axis within the assemblies additionally has a heavily thickened threaded or solidly formed, casted or otherwise manufactured for the acceptance of the threaded solid bar for tightening through the attachment housings fastened, welded, formed, glued or epoxy of the faces of the collet/cone assemblies or to the face surface of desired, products, structures, casings, pipes, castings in which may need to be placed or inserted.

In an example, shock absorption elements are placed within the heavily threaded passageway which is constructed for the left and right handed tightening system to be rotated into. Each of the two housings may be equipped in this fashion so that each tightens towards the center axis. This may produce the surface to face acceptance necessary for the collet/cone assembly to be securely matched to the products to be installed. Multiple selections of the oversized fasteners may be strategically placed to the users and manufacturers recommendations for sizes and weights matching multiple configurations of hammers, cone/collets, or products being installed.

The use of chains, straps, welding of attachment plates have failed in casing damages to the host structures 207 being installed, damage to equipment 212, and injury to person operating the equipment. Instead, the example of assemblies 123, utilizing hammers 212 to install pipe, casings, or other structures 207 has a high frequency rate developed by the amount of blows per minute to the collet assemblies 123, in which to transfer energy of the blow/frequency to the distal end of the casing, pipe, or drainage structure 207 being installed. For example a 24 inch Earthtool Hammer 212 produces 2 million inch pounds of force 177 times a minute.

Now because of developments in product ramming, there are larger and more powerful hammers 212 with devices. For example the 34 inch hammer 212 produces over 3,000 tons per blow 128 times a minute which produces extreme pressure blow/frequency rates to the structures being installed with the attachments, such as cone/collet assemblies 123, connection assemblies such as chains, straps, chain tightening mechanisms', and welded plates. The newly improved mounting housings 304, to which the collet/cone assemblies 123 are matched to create a centralizing axis for the absorption assembly 300 to become connected with fasteners 306 to the attached housings 304.

The further examples within the absorption assembly 300 have threaded ends in which to receive and a solid left and right handed threaded bar 309 and within the threaded bar is a multi-hexagonal selection for receiving tightening device 308 but not limited to such as a wrench. The user may place multiple housing assemblies 304 which are welded, fastened, glued, molded or formed on the collets/cone assemblies 123 and to the structure being installed 207 or in some cases extracted.

The tightening bar 309 may be retracted but within the threaded sections of the absorption devise 300 so that additional tightening 309 may be achieved to assure the face to surface, and surface to face connection are sufficiently completed with no gaps. Now that the conducting surface face to face surface has been achieved with the large fastener assembly (see, e.g., FIG. 6) between the collet/cone assemblies 123 and the structure being installed 207 or extracted, the hammer 212 is installed.

There are additional features within the examples illustrated which include, but are not limited to, the housings 304 with elongated holes 303, located in the mounting housings 304, having a shock absorbing assemblies 301, located within the centralized axis of the housings 304 becoming parallel adjoining the centralizing axis of the absorption assembly 300 together. The elongated void sections 303 within the housing 304 may create additional forgiveness if it were to become applicable. Additionally the shock absorption component 301 for mounting ends 305 of the tightening bar 309 have an internal protection sleeve 302 to reduce abrasion wear to the absorption component 301 from the fasteners 306.

Figure 7:
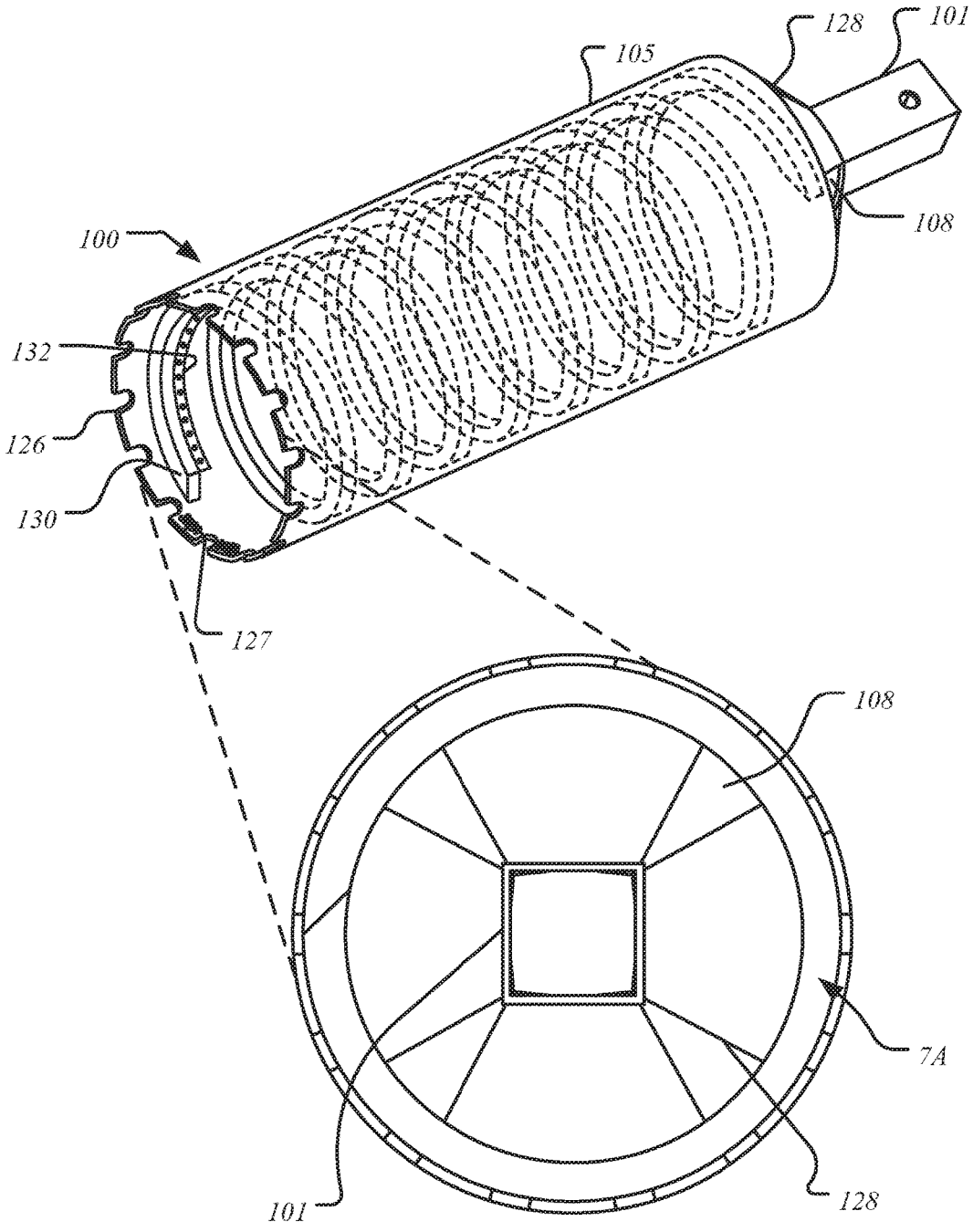
FIGS. 7-9 show various views of an example forward articulating cleaning apparatus.
Figure 8:
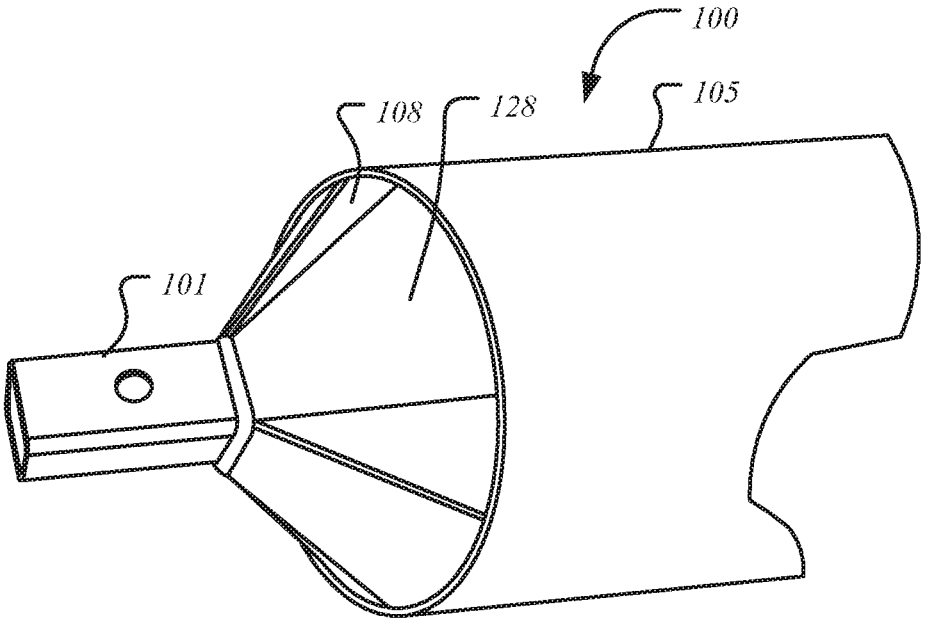
Figure 9:
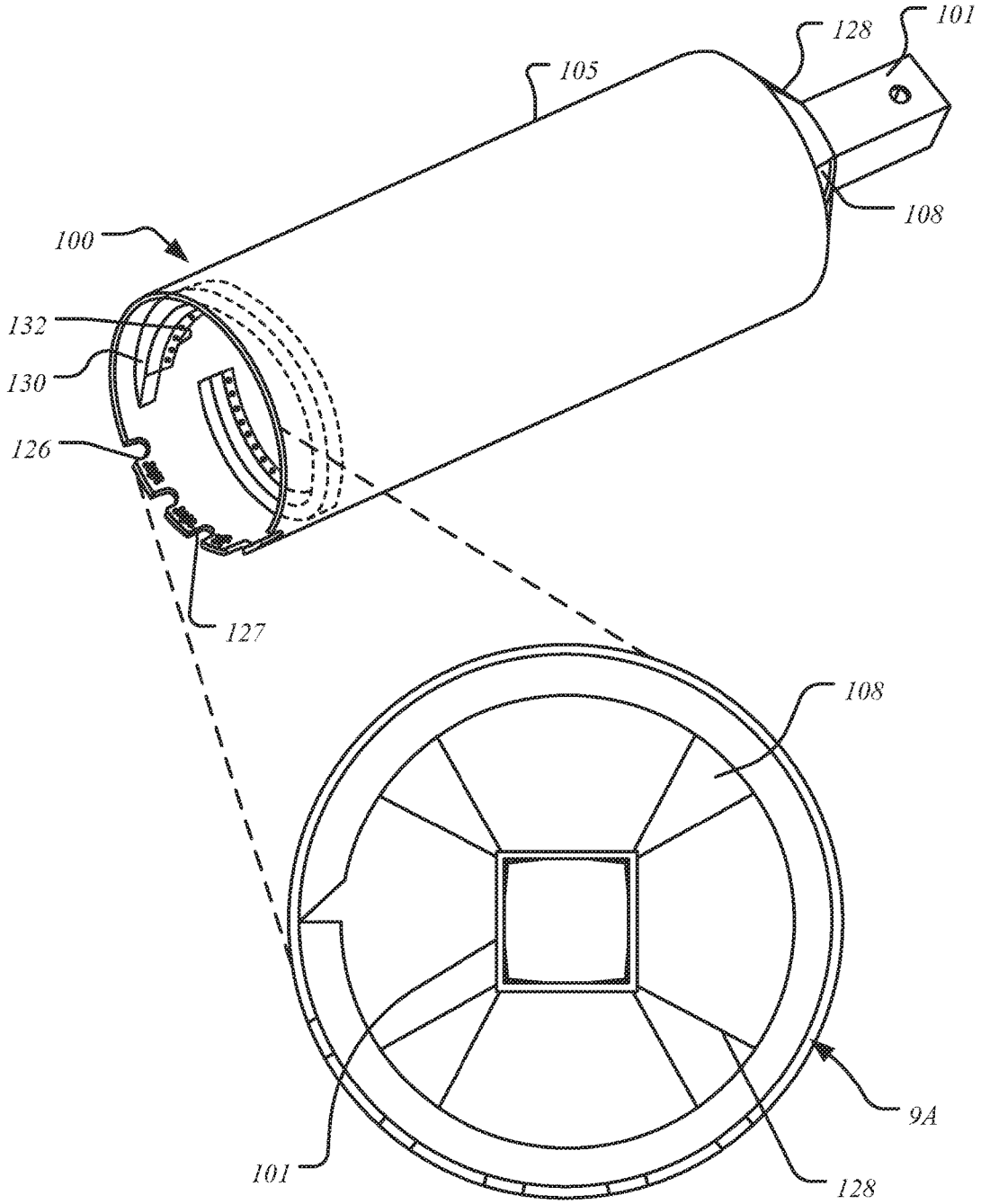

FIGS. 7-9 show an example forward articulating cleaning apparatus 100. FIG. 7 also shows a front end view 7A looking in from the opening at distal edge 107, FIG. 8 is a partial cutaway view of the proximal end 128. FIG. 9 also shows a front end view 9A looking in from the opening at distal edge 107. The example apparatus 100 may be implemented for cleaning and/or removal of structures such as but not limited to drainage structures, collets, pipes, etc.

The example forward articulating cleaning and removal apparatus 100 includes a housing 105. During operation, the housing may be extended into the structure to be cleared through an open end of the structure to be cleared (e.g., inlet or outlet of the drainage structure). The example apparatus 100 includes a distal edge 107 formed on the housing 105. The distal edge may be configured to cut or loosen debris. For example, the distal edge may include a cutting edge, such as a blade 126 (e.g., toothed or sharpened) and/or roughened or hard material (e.g., diamond or carbide) edge 127. The rough cutting edge 127 may be provided on one or more teeth 126 and/or at any suitable position(s) in the housing 105.

At least one coil 130 may be provided within the housing 105. The coil is attached inside of the housing 105 and provides support for the housing 105 without need for an internal support rod or other support structure. The coil 130 may also include a cutting edge, such as an edge 132 (e.g., toothed or sharpened, and/or roughened or hard material such as diamond or carbide). The edge 132 is shown along a portion of the coil 130, but may be provided along any length of the coil 130. The coil 130 (or coils) may be substantially corkscrew shaped along an internal surface of the housing 105. Operation of the coil 130 enables cut or loosened debris to move away from the distal edge 107 formed on the housing 105, toward a proximal end 128 of the housing 105.

The proximal end 128 may be cone or conical shaped. A debris escape opening 108 may be formed in the proximal end 128 of the housing 105.

The proximal end 128 may also have a stem 101. In an example, the stem is sealed to provide air and/or fluid to the distal edge of the housing, to assist in cutting, cooling, or melting of debris while limiting contamination of soils or turbidity to nearby water ways. The stem may also include a telescoping member (not shown, but configured similar to a telescoping automobile antenna) to move the housing in a forward and reverse direction.

The stem 101 may provide a connection to a rotational power source (see, e.g., FIGS. 2 and 4) to drive the housing 105. In an example, the rotational power source may be operated to drive the housing 105 by forward-rotation to move debris from the structure to be cleared and into the housing 105. The housing may be extracted from the structure to be cleared after the housing 105 is loaded with debris and/or other material. The housing 105 may be reverse-rotated to release debris from the housing 105.

In an example, the rotating motion of the housing tightens a large and/or elongated debris object (e.g., a pipe, log, etc.) into the housing. Reversing the rotating motion, loosens the debris object from the housing for removal. As such, the housing and the coil may be operated to engage or lock pole-shaped or cylindrical debris within the housing for extraction as the housing is withdrawn from the structure to be cleared.

Before continuing, it should be noted that the examples described above are provided for purposes of illustration, and are not intended to be limiting. Other devices and/or device configurations may be utilized to carry out the operations described herein.

Principles are now described which may be, but are not limited to methods for cleaning, evaluations, lining, profiling, swallowing, and relocations for new structure alignment and completions. The methods include decision making and profiling which may be considered. The forgoing continued outline includes multiple example methods according to aspects of the present disclosure for the decision making of maintenance or construction with profiling.

It is noted that the operations shown and described herein are provided to illustrate example implementations. It is noted that the operations are not limited to the ordering shown. Still other operations may also be implemented.

In an example, an observation that has been brought to attention of the transportation surface or facility owner. There is possible surface or subsurface occurrences that are visible.

Notice needs to bring awareness to others who may own adjoining properties or protected waterways. Advancing to history or ownerships of agencies regulated or otherwise, permitting and permissions need to become acquired.

Compliances to Storm Water Pollution Plan applications must be filed, with environmental controls, and comply with Federal and State Regulatory Regulations.

Once the owner of the structure needing assistance has achieved all of the necessary requirements a qualified licensed and insured contractor is contacted. The contractor upon an onsite visit of the affected area is supplied with history, geotechnical information, design drawings and copies of requirements and guidelines to be followed.

Questions answers with notes are documented so that the contractor or employee of the owner surface may draft a work plan. Work plans may consist of Company Qualification packets, emergency contact information, permits, regulatory requirements and time line of experiences of persons doing the work.

License agreements, ground engaging or circumstantially warranted equipment to be used with tooling selections, workable pad, barge, boat, rail system provide access to work area. Owner of transportation surface or facility decides where debris removals are to be placed.

Once briefing is done about the area work crews establish environmental controls, processes to work from, stage equipment, select tools and start work to approved work plans.

Using the correct methods, tooling and practices debris are removed, e.g., as illustrated in FIG. 5. Multiple passes may have occurred and within this example that have used additional angular stem and connections. However within this structure, degradations have occurred with a large debris obstruction in the way. This may be noticed by the trained and qualified contractor when the tooling at the distal end becomes locked into the failed structure and very large debris. However the contractor is utilizing the correct ground engaging or circumstantially warranted equipment and tooling. The contractor can safely counter rotate freely from the entanglement without disconnection of the tooling or angular stem connections which has now been safely removed.

A visual inspection by man entry once confined space requirements have been met or by camera shows the Refusal blockage. The contingencies in the work plan explain procedures approved by the owner may be implemented.

The prior history is disclosed to the contractor of choice, who from practical experiences advised engineering of options through the approved work plan. In this example, known large debris were filled into a hole created by degradation or band failure separation of a culvert, e.g., as illustrated in FIG. 5.

The experienced and qualified contractor has calculated potential volumes of materials that should potential be removed from the structure. Using the DHA debris removal tooling (e.g., as illustrated in FIG. 4), the contractor advances the tooling for further investigation to view the existing structure. Being experienced in the skill and qualified in the art the contractor removes the equipment and tooling to find that the structure is capable of being swallowed.

The contractor ceases cleaning operations do to abnormal debris exiting from the distal end of the reach of the current tooling to the proximal end where the debris are being removed from the structure.

Further viewing by man entry using confined space requirements or camera prove that the structure is misaligned with potential for caving under the traveled surfaces.

Survey with the calculations lengths of the stem sections and past history combined prove that this structure may be successfully swallowed.

At times, a suitable structure that debris obstruction may be been removed and show degradations with structures being within a suitable alignment. If the hydrology within the flowing area may allow a liner which meets acceptable loading limits shall be installed.

Liners may be selected or accepted with regards to meeting soils or chemical make ups of the surrounding area, sizing limitations or environmental concerns in the area of installation.

Grouting compounds must meet manufacture requirements, load ratings, strengths, and chemical makeup of the area soils. Grout compounds are to be applied, pumped or otherwise industry manufacture recommended to which the annular voids are completely filled. As illustrated in FIG. 5, a profiled failing culvert is being swallowed by a steel casing upsizing the structure for additional flow capacity.

The work plan developed by the contractor has submitted the wall thickness and required size to the profile of the pipe or casing being installed.

Depending on certain soil conditions the owner may request a certain chemical makeup of the steel compositions along with manufacture certificates of proof. Load ratings, lengths, diameters, or soil conditions of the area require strengths and wall thickness of pipe or casing products to be installed. Note: From factual experiences with persons in engineering and design, who have very limited knowledge in trenchless technology, have actually, requested unsuitable pipe requirements to be installed.

By way of illustration, a ⅜ thick thin wall pipe may be requested to be installed for 300 feet is silted soils under a traveled highway for gravity flow sewer line. The depth was to be 6 feet and a 2% down at the distal end. The steel casing is a pipe rammed into the soils. Because the pipe was not engineered properly to have the wall strength and correct thickness, the pipe started to dive 90 feet into the traveled fill under the highway. The contractor not qualified in the skill and the art continued to install sections without cleaning and profiling the inside of the pipe. At 213 feet the newly installed casing came in contact with a 24 inch known water main at 10 feet deep. There was no ability to shut off the main which totally drain the storage tower and shut the city off along with mass flooding of the highway and washing out the road surface.

Excavation may be necessary to adjust Line and grade to the profile. Grade pad, geotechnical products or railings or supports such as a pipe mule have been achieved with the pipe or casing aligned to encompass and swallow the existing culvert. The appropriate soil shoe has been welded sufficiently to the frontal/distal end with lubrication lines attached to the host pipe, the pipe or structure being installed is now placed on the multiple components mentioned and rechecked for line and grade.

Cone/collet assemblies are affixed to the structure being installed with the multi large absorption components attached to the structure and cone/collet assemblies. Once the face to surface and surface to face is established satisfactorily, the ground engaging or circumstantially warranted equipment necessary to safely lift and position the hammer components are then installed, hammer supply turned on by the qualified person knowledgeable in the skill and art of operation with certifications of the equipment.

The pipe casing or structure being installed now is moving forward, swallowing the structure with lubrications being supplied by pumping a regulated amount, not to wash but lubricate. The traveling rates of the forward motion are monitored with identify marks placed on the host being installed.

Another section is now required to be added as the host structure has now met the prior designated mark, to which room is needed to attach another section. All supply systems are now shut off such as air in this case and lubrications.

The ground engaging or circumstantially warranted equipment necessary and capable of safely lifting the hammer and Colette assemblies are attached with appropriate lifting devices such as but not limited to certified cables or slings to the hammer. The hammer is then reversed with the air supply and set aside with the collet assembly then being removed next.

The contractor views the internal debris with checking the profile of the host structure being installed. The contractor is satisfied with the results and places another section of pipe, casing or structure being installed in place to be attached by welding, fusing, perma-locked or other examples within this discussion mentioned are repeated until the hosting structure slows in travel or meets refusals. Within this discussion a refusal is met and forward progress has halted.

The contractor has planned for this to happen because of properly following the protocol to profile and discovery in history.

The examples of the Forward Articulated Cleaning Apparatus is assembled with the DHA is attached 111 to the proximal end of the elongated housing 105 which provides the centralizing axis angular connection 102 to the distal end of the first angular stem 113. The first angular stem 113 at the proximal end is attached to the ground engaging or circumstantially warranted equipment 202 distal angular connections 102 at the power sources 203 and connected to supply line 104.

The contractor qualified with training in the skill and art proceeds to move forward into the new host structure 207 with the degraded culvert and debris inside 201. The correctly sized tooling 105/111 while rotating in a clockwise motion, with supply line 104 turned on is now gathering the debris 201 into the housing 105. The locking action of the spherical coil assembly is drawing the debris 201 and locking the debris inside 204 while the chiseling bit 112 is cutting away the old culvert from its self while loosening or downsizing the debris 206. The tooling housing 105 becomes full and the warranted equipment 202 is reversed to pull out the debris 201.

The tooling housing 105 is then cleared of debris 201 and the processes are repeated until the obstruction 206 has been resolved. The contractor reinstalls the hammer assembly components in its entirety within the above previous discussion to repeat the pipe ramming processes of swallowing 207.

In some cases, the profile may show that an existing structure collapse is severally misshaped or miss-configured into a bow or called as a (banana) under a traveled surface. This issue has been encountered, and the apparatus provides a solution of a flow able mix grout design that may be pumped, injected and pressured to fill all voids, in around, and throughout the existing collapsed or miss figured structure and under the traveled surfaces.

In providing a solution to the current discussion is to move left or right of the center line of the existing damaged structure installing the next structure with, preferred methods of pipe ramming. The components, practices and methods of the pipe ramming method processes, are in part, having been explained within the continued discussion.

The methods of doing the mentions of moving the structure in the area does not change the stream bed design. This profiled process is saving 75% of additional cost in agency requirements over new construction and considered to be maintenance installation.

After the completions with in the profiling enclosed in the discussions of the above mentioned articles have been archived, reclamation process begins to the work plans. Designed headwalls, riprap, erosion controls and redeveloping wildlife and fish habitat in part are completed to owners request to provisions within the contracts however written prior to commencing work.

It is noted that the examples shown and described are provided for purposes of illustration and are not intended to be limiting. Still other examples are also contemplated.

The invention claimed is:

1. A forward articulating cleaning and removal apparatus for cleaning a structure to be cleared, the apparatus comprising:

a housing to extend into the structure to be cleared through an open end of the structure to be cleared;

a distal edge formed on the housing to cut or loosen debris;

at least one coil within the housing to move the cut or loosened debris away from the distal edge formed on the housing to a proximal end of the housing; and a debris escape opening formed in the proximal end of the housing.

2. The apparatus of claim 1, further comprising a stem at the proximal end of the housing, the stem for connecting to a rotational power source to drive the housing.

3. The apparatus of claim 1, further comprising an attached hammer assembly extending from the distal edge formed on the housing.

4. The apparatus of claim 3, wherein the attached hammer assembly is operable by compressed air, water, steam, hydraulic fluid, or electrical power.

5. The apparatus of claim 1, wherein the housing is forward-rotated to move debris from the structure to be cleared and into the housing.

6. The apparatus of claim 1, wherein the housing is extracted from the structure to be cleared after the housing is loaded.

7. The apparatus of claim 1, wherein the housing is reverse-rotated to release debris from the housing.

8. The apparatus of claim 1, wherein the at least one coil is attached inside of the housing to provide support without any internal rod.

9. The apparatus of claim 1, wherein the proximal end is conical shaped.

10. The apparatus of claim 1, further comprising a sealed stem connection to provide air and/or fluid to the distal edge of the housing, to assist in cutting, cooling, or melting of debris while limiting contamination of soils or turbidity to nearby water ways.

11. The apparatus of claim 1, further comprising a telescoping stem connection to move the housing in a forward and reverse direction.

12. The apparatus of claim 1, wherein rotating motion of the housing tightens a debris object into the housing, and reversing the rotating motion loosens the debris object from the housing for removal.

13. The apparatus of claim 1, wherein the housing and the coil is configured to engage or lock pole-shaped debris within the housing for extraction as the housing is withdrawn from the structure to be cleared.

14. The apparatus of claim 1, further comprising a frequency shock absorption assembly with securement blocks.

15. The apparatus of claim 1, further comprising a cutting edge on the at least one coil.

16. The apparatus of claim 15, wherein the cutting edge on the at least one coil has a rough surface portion.

17. The apparatus of claim 1, further comprising a cutting edge on the distal edge.

18. The apparatus of claim 17, wherein the cutting edge on the distal edge has a toothed blade portion.

19. The apparatus of claim 17, wherein the cutting edge on the distal edge has a rough surface portion.

20. A forward articulating cleaning and removal apparatus for cleaning a drainage structure comprising:

a housing to extend into the drainage structure through an open end of the drainage structure;

a distal edge formed on the housing to cut or loosen debris within the drainage structure;

at least one coil within the housing to move the cut or loosened debris from the drainage structure away from the distal edge formed on the housing toward a proximal end of the housing;

a debris escape opening formed in the proximal end of the housing;

a stem at the proximal end of the housing, the stem for connecting to a rotational power source to drive the housing; and at least one cutting edge on the distal edge of the housing and/or the at least one coil within the housing.

* * * * *